US007881641B2

(12) United States Patent
Aoki et al.

(10) Patent No.: US 7,881,641 B2
(45) Date of Patent: Feb. 1, 2011

(54) DEVELOPING CARTRIDGE, DEVELOPING DEVICE, AND IMAGE FORMING APPARATUS

(75) Inventors: Takeshi Aoki, Matsumoto (JP); Katsumi Okamoto, Azumino (JP); Koji Migita, Matsumoto (JP); Makoto Sato, Matsumoto (JP); Masashi Nakatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 47 days.

(21) Appl. No.: 12/413,412

(22) Filed: Mar. 27, 2009

(65) Prior Publication Data

US 2009/0245884 A1 Oct. 1, 2009

(30) Foreign Application Priority Data

Mar. 31, 2008 (JP) ..... 2008-089098
Mar. 31, 2008 (JP) ..... 2008-089961

(51) Int. Cl.
*G03G 15/08* (2006.01)

(52) U.S. Cl. ..... 399/254; 399/258

(58) Field of Classification Search ..... 399/254, 399/256, 258

See application file for complete search history.

(56) References Cited

U.S. PATENT DOCUMENTS 5,950,056 A * 9/1999 Hamamichi et al. ..... 399/256
6,343,200 B1 * 1/2002 Hatano et al. ..... 399/254
7,610,001 B2 * 10/2009 Tsunemi et al. ..... 399/254
2007/0025773 A1 * 2/2007 Tateyama et al. ..... 399/254
2007/0122202 A1 * 5/2007 Taguma et al. ..... 399/254
2007/0166079 A1 * 7/2007 Ichikawa et al. ..... 399/254
2007/0274742 A1 * 11/2007 Nakayama et al. ..... 399/254
2008/0205938 A1 * 8/2008 Hirose ..... 399/254
2008/0253810 A1 * 10/2008 Tateyama et al. ..... 399/258
2008/0317508 A1 * 12/2008 Terai et al. ..... 399/254
2009/0103951 A1 * 4/2009 Tsuda ..... 399/254
2009/0245878 A1 * 10/2009 Aoki et al. ..... 399/254

FOREIGN PATENT DOCUMENTS

JP 11-231631 8/1999
JP 2000-181216 6/2000
JP 2002-251070 A * 9/2002
JP 2003-057929 2/2003
JP 2003-248371 9/2003
JP 2006-163292 6/2006
JP 2006-221012 8/2006
JP 2007-010981 1/2007
JP 2008-039986 2/2008
JP 2008-040269 2/2008
JP 2008-058469 3/2008

* cited by examiner

*Primary Examiner*—Sophia S Chen
(74) *Attorney, Agent, or Firm*—Workman Nydegger

(57) ABSTRACT

A developing cartridge includes: a developer carrier which carries toner; a toner supply member which supplies the toner to the developer carrier; a regulation member which regulates an amount of toner on the developer carrier; a developing chamber which has the developer carrier and the toner supply member; a transport section which is connected to an upper portion and a lower portion of the developing chamber and transports the toner from the lower portion of the developing chamber to the upper portion of the developing chamber; and a transport member which is disposed inside the transport section and transports the toner while agitating the toner. A capacity of the transport section is larger than a capacity of the developing chamber.

16 Claims, 12 Drawing Sheets

DEVELOPING CARTRIDGE, DEVELOPING DEVICE, AND IMAGE FORMING APPARATUS

The entire disclosure of Japanese Patent Application No. 2008-089098, filed Mar. 31, 2008 and Japanese Patent Application No. 2008-089961, filed Mar. 31, 2008 are incorporated by reference herein.

BACKGROUND

1. Technical Field

The present invention relates to a developing cartridge capable of developing an electrostatic latent image on a latent image carrier by developer, a developing device, and an image forming apparatus.

2. Related Art

There is known an electrographic recording type image forming apparatus exposing and forming an electrostatic latent image on the surface of a latent image carrier on the basis of image data. This image forming apparatus forms an image by allowing a developing device to develop the electrostatic latent image using toner and transferring a toner image formed on the surface of the latent image carrier onto a record medium such as a record sheet. Recently, the electrographic recording type image forming apparatus has been generally designed so as to detachably mount a toner cartridge incorporated with or separated from a developing device and storing toner. In addition, when the stored toner is consumed by repeatedly developing the electrostatic latent image on the surface of the latent image carrier, the toner cartridge is exchanged to supplement toner for developing the electrostatic latent image on the surface of the latent image carrier.

In the developing device, since the toner in the developing chamber is agitated for a long time by an agitating member, a toner supply roller, and a regulation blade, a charging capability deteriorates. When the toner cartridge is exchanged and new toner and the deteriorated toner remaining in the developing chamber are agitated and mixed for use, the new toner with a high charging capability is selectively charged and the deteriorated toner is insufficiently charged. Therefore, since a total charge amount of the agitated and mixed toner becomes insufficient, control leakage or blushing to a non-image portion may occur. In order to prevent the control leakage or the blushing, for example, JP-A-2000-181216 discloses a technique for processing the deteriorated toner remaining in the developing chamber in such a manner that driving time of a developing device is counted to perform forcible writing in the non-image portion in accordance with the driving time and toner deteriorated in the charging capability in the developing chamber is consumed.

However, this known technique has a problem in that the toner different in a deterioration state (charging property) in the developing chamber coexist and the control leakage or the blushing may occur due to mixture of the toner different in the charge amount of toner.

SUMMARY

An advantage of some aspects of the invention is that it provides a developing cartridge capable of allowing the charge amount of toner in a developing chamber to be uniform, a developing device, and an image forming apparatus.

According to an aspect of the invention, there is provided a developing cartridge including: a developer carrier which carries toner; a toner supply member which supplies the toner to the developer carrier; a regulation member which regulates an amount of toner on the developer carrier; a developing chamber which has the developer carrier and the toner supply member; a transport section which is connected to an upper portion and a lower portion of the developing chamber and transports the toner from the lower portion of the developing chamber to the upper portion of the developing chamber; and a transport member which is disposed inside the transport section and transports the toner while agitating the toner. Moreover, a capacity of the transport section is larger than a capacity of the developing chamber. With such a configuration, since the toner is agitated in numerous portions in the transport section, it is possible to allow a charge amount of toner in the developing chamber to be almost uniform.

In the developing cartridge according to this aspect of the invention, time during which the transport member agitates the toner in the transport section may be longer than time during which the toner passes through the developing chamber. With such a configuration, since the time during which the toner is agitated in the transport section is longer, it is possible to allow the charge amount of toner in the developing chamber to be almost uniform.

In the developing cartridge according to this aspect of the invention, the transport section may include a portion below a lower tangent line of the developer carrier and the toner supply member and a portion in which the transport member is disposed. With such a configuration, since distinguishment from the developing chamber is clear, measurement of the charge amount of toner is easy.

In the developing cartridge according to this aspect of the invention, the transport member may include: a lower transport member which is disposed in the lower portion of the developing chamber and collects the toner; an upward transport member which transports the toner from a lower side of the developing chamber to an upper side of the developing chamber; and an upper transport member which is disposed in the upper portion of the developing chamber and transports the toner to a developing chamber entrance. With such a configuration, since the time during which the toner is agitated in the transport section is longer, it is possible to allow the charge amount of toner in the developing chamber to be almost uniform.

In the developing cartridge according to this aspect of the invention, the upper transport member may include a plurality of transport members which are arranged in parallel and transport the toner alternately in directions reverse to each other. With such a configuration, since the time during which the toner is agitated in the transport section is further longer, it is possible to allow the charge amount of toner in the developing chamber to be almost uniform.

In the developing cartridge according to this aspect of the invention, the regulation member may be disposed below the developer carrier. With such a configuration, the toner passing through a nip portion between the developing roller and the toner supply roller more easily drops to the lower transport passage.

According to another aspect of the invention, there is provided a developing device including: the developing cartridge and a toner cartridge which supplies toner. With such a configuration, since the toner is agitated in numerous portions in the transport section, it is possible to allow a charge amount of toner in the developing chamber to be almost uniform, when new toner is supplied by the toner cartridge.

According to still another aspect of the invention, there is provided an image forming apparatus at least including: a latent image carrier on which an electrostatic latent image is formed; a developing device which develops the electrostatic latent image by developer to form a toner image on the latent image carrier; a transferring unit which transfers the toner image formed on the latent image carrier onto a transfer medium; and a fixing unit which fixes the toner image transferred onto the transfer medium. Moreover, the developing device is mounted on the image forming apparatus. With such a configuration, it is possible to form a high quality image with almost uniform charge amount of toner.

According to still another aspect of the invention, there is provided a developing device including: a developer carrier which carries toner; a toner supply member which supplies the toner to the developer carrier; a regulation member which regulates an amount of toner on the developer carrier; a developing chamber which has the developer carrier and the toner supply member; a transport section which is connected to an upper portion and a lower portion of the developing chamber and transports the toner from the lower portion of the developing chamber to the upper portion of the developing chamber; a transport member which is disposed inside the transport section and transports the toner while agitating the toner; and a toner giving section which is connected to the transport section and supplies the toner to the transport section. With such a configuration, since the toner having different charge can be agitated in the transport section before the supply of the toner to the developing chamber, it is possible to allow the charge amount of toner in the developing chamber to be almost uniform.

In the developing device according to this aspect of the invention, the transport section may include a lower transport passage being connected to a lower portion of the developing chamber and collecting the toner, an upward transport passage being connected to the lower transport passage and transporting the toner from the lower portion to an upper portion of the developing chamber in the outside of the developing chamber, and an upper transport passage connecting the upward transport passage to the upper portion of the developing chamber and transporting the toner to the developing chamber. Moreover, the toner giving section may be connected to the lower transport passage. With such a configuration, since the toner is agitated in numerous portions in the transport section, it is possible to allow the charge amount of toner in the developing chamber to be almost uniform.

In the developing device according to this aspect of the invention, the upper transport passage may be connected to the upper portion of the developing chamber in a center in an axial direction of the developer carrier. With such a configuration, it is possible to smoothly and uniformly supply the toner to the developing chamber.

In the developing device according to this aspect of the invention, the lower transport passage may include a lower transport member. Moreover, the toner giving section may be connected to an upstream side in a transport direction of the lower transport member in the lower transport passage. With such a configuration, since the toner is agitated in the numerous portions in the transport section, it is possible to allow the charge amount of toner in the developing chamber to be further almost uniform.

In the developing device according to this aspect of the invention, the toner giving section may include: a toner cartridge; a toner giving passage which connects the toner cartridge to the transport section; and a toner giving member which transports the toner in the toner giving passage. Moreover, the toner giving member and the lower transport member may be the same member. With such a configuration, since both the toner giving member and the lower transport member can be driven by one driving unit, it is possible to reduce the number of constituent elements and energy.

In the developing device according to this aspect of the invention, the toner giving section may include: a toner cartridge; a toner giving passage which connects the toner cartridge to the transport section; and a toner giving member which transports the toner in the toner giving passage. Moreover, the toner giving member and the lower transport member may be different from each other. With such a configuration, a design can be made more freely.

In the developing device according to this aspect of the invention, the toner giving passage may be disposed in a direction intersecting the transport direction of the lower transport member. With such a configuration, since it is possible to make efficient use of the space in the axial direction of the developer carrier, the design can be made more freely.

According to still another aspect of the invention, there is provided an image forming apparatus at least including: a latent image carrier on which an electrostatic latent image is formed; a developing device which develops the electrostatic latent image by developer to form a toner image on the latent image carrier; a transferring unit which transfers the toner image formed on the latent image carrier onto a transfer medium; and a fixing unit which fixes the toner image transferred onto the transfer medium. Moreover, as the developing device, the developing device described according to the aspect of the invention is mounted on the image forming apparatus according to one of the aspects of the invention. With such a configuration, it is possible to form a high quality image with the almost uniform charge amount of toner.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the drawings.

Figure 1:
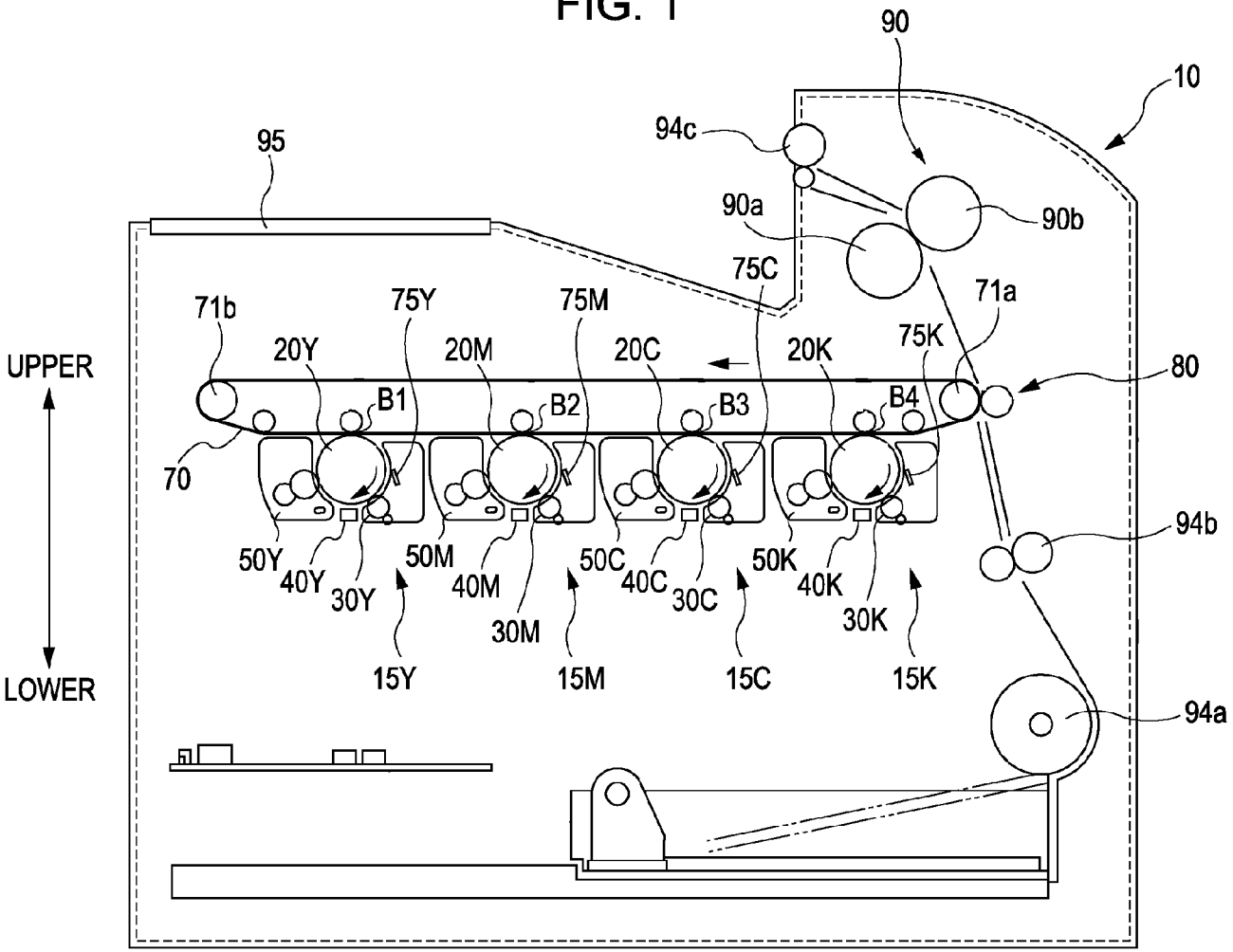
FIG. 1 is a diagram illustrating an image forming apparatus according to embodiments.
Figure 2:
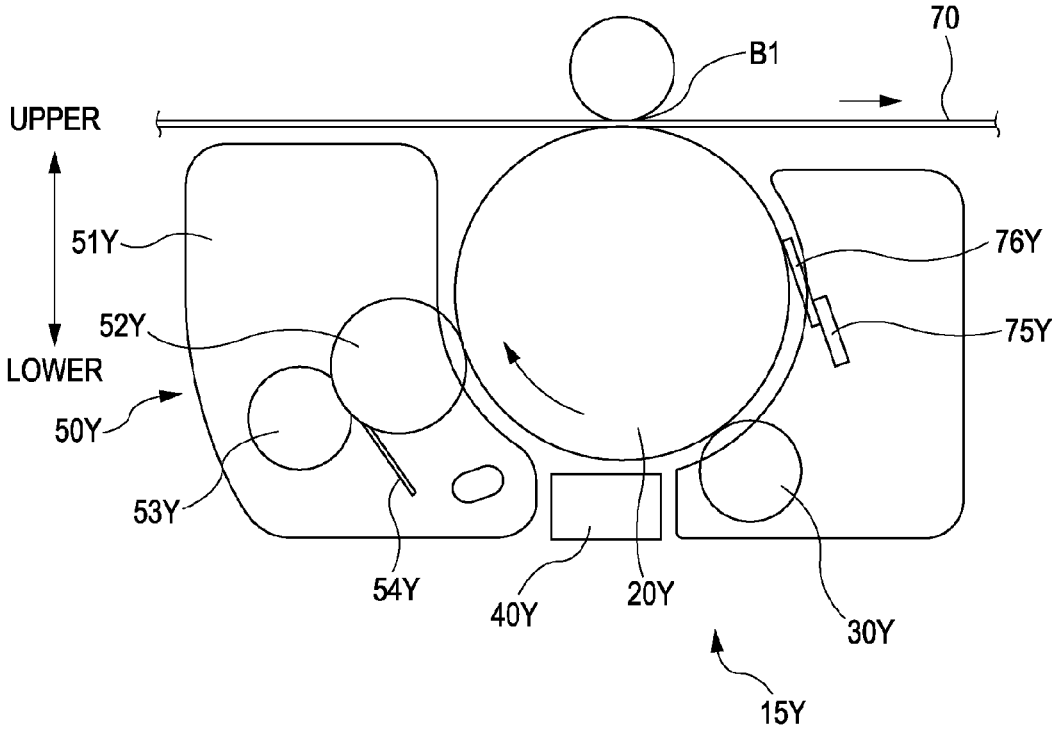
FIG. 2 is a sectional view illustrating the periphery of a photosensitive member and major constituent elements of a developing cartridge.

FIG. 1 is a diagram illustrating an image forming apparatus including a developing device according to the embodiments of the invention. FIG. 2 is an enlarged diagram illustrating a yellow image forming station in FIG. 1.

As shown in FIG. 1, an image forming apparatus 10 includes four image forming stations 15 (Y, M, C, and K), an intermediate transferring belt 70 as an example of an intermediate transferring member, a secondary transferring unit 80, a fixing unit 90, a display unit 95 which is a notification unit for notifying messages to a user and is formed by a liquid crystal panel including, and a control unit 100 which controls these units to perform operations of the image forming apparatus.

The image forming stations 15 (Y, M, C, and K) have a function of forming an image using yellow (Y) toner, magenta (M) toner, cyan (C) toner, and black (K) toner, respectively. Since the image forming stations 15 (Y, M, C, and K) have the same configuration, only the configuration of the image forming station 15Y will be described below.

As shown in FIG. 2, the image forming station 15Y includes a charging unit 30Y, an exposure unit 40Y, a developing cartridge 50Y as an example of a developing device, a primary transferring section B1, a photosensitive member cleaning unit 75Y as an example of a latent image carrier cleaning unit in a rotation direction of a photosensitive member 20Y as an example of a latent image carrier. As described above, the image forming stations 15M, 15C, and 15K have corresponding structures and as such include corresponding charging units 30M, 30C, and 30K, exposure units 40M, 40C, and 40K, developing cartridges 50M, 50C, 50K, and photosensitive member cleaning units 75M, 75C, and 75K.

The photosensitive member 20Y includes a cylindrical body and a photosensitive layer formed on the outer circumferential surface of the cylindrical body and rotates about a central axis. In this embodiment, the photosensitive member 20Y rotates clockwise, as indicated by an arrow.

The charging unit 30Y is a unit which electrically charges the photosensitive member 20Y. A latent image is formed on the charged photosensitive member 20Y by radiating a laser from the exposure unit 40Y.

The exposure unit 40Y includes a semiconductor laser unit, a polygon mirror, and an F-θ lens. The exposure unit 40Y radiates a modulated laser onto the charged photosensitive member 20Y on the basis of an image signal input from a host computer (not shown) such as a personal computer or a word processor.

The developing cartridge 50Y is a unit which develops the latent image formed on the photosensitive member 20Y by use of the yellow (Y) toner. The developing cartridge 50Y includes a developing roller 52Y as an example of a developer carrier and a toner supply roller 53Y as an example of a toner supply member, which are disposed inside a developing chamber 51Y to which new toner is supplied from an exchangeable toner cartridge (not shown). A regulation blade 54Y as a regulation member comes in contact with the developing roller 52Y to thin the toner on the developing roller 52Y.

The primary transferring section B1 is a unit which transfers a yellow toner image formed on the photosensitive member 20Y to an intermediate transferring belt 70. When four color toners are sequentially overlapped and transferred to the primary transferring sections B1, B2, B3, and B4, a full-color toner image is formed on the intermediate transferring belt 70.

The intermediate transferring belt 70 is an endless belt which is suspended on a belt driving roller 71*a* and a driven roller 71*b*. The intermediate transferring belt 70 is rotatably driven while coming in contact with the photosensitive members 20 (Y, M, C, and K).

The secondary transferring unit 80 is a unit which transfers a mono-color toner image or the full-color toner image formed on the intermediate transferring belt 70 onto a transfer medium such as a paper sheet, a film, or a cloth.

The fixing unit 90 includes a fixing roller 90*a* and a pressuring roller 90*b* and forms a permanent image by melting and fixing the mono-color toner image or the full-color image transferred on the transfer medium on the transfer medium.

The photosensitive member cleaning unit 75Y includes a photosensitive member cleaning blade 76Y made of rubber and coming in contact with the surface of the photosensitive member 20Y. The photosensitive member cleaning unit 75Y is a unit which scrapes and removes the toner remaining on the photosensitive member 20Y by use of the photosensitive cleaning blade 76Y after the toner image is transferred onto the intermediate transferring belt 70 by the primary transferring section B1.

Next, operations of the image forming apparatus 10 having the above configuration will be described.

First, when an image signal and a control signal are input from the host computer (not shown) to a main controller of the image forming apparatus through an interface, the photosensitive member 20Y, the developing roller 52Y included in the developing cartridge 50Y, the toner supply roller 53Y, the intermediate transferring belt 70, and the like are rotated by control of a unit controller in accordance with an instruction supplied from the main controller. The photosensitive member 20Y is charged sequentially at a charging location by the charging unit 30Y, while the photosensitive member 20Y is rotated.

A charged area of the photosensitive member 20Y reaches an exposure location with the rotation of the photosensitive member 20Y. Then, a latent image according to yellow Y image information is formed in the charged area by the exposure unit 40Y.

The latent image formed on the photosensitive member 20Y reaches a development location with the rotation of the photosensitive member 20Y and is developed by the developing cartridge 50Y. In this way, a toner image is formed on the photosensitive member 20Y.

The toner image formed on the photosensitive member 20Y reaches a location of the primary transferring section B1 with the rotation of the photosensitive member 20Y and is transferred on the intermediate transferring belt 70 by a primary transferring unit. At this time, a primary transfer voltage having a polarity opposite to a charging polarity of toner is applied to the primary transferring unit. In consequence, toner images of four colors respectively formed on the photosensitive members 20 (Y, M, C, and K) are transferred in an overlapped manner on the intermediate transferring belt 70 to form the full-color toner image on the intermediate transferring belt 70.

The intermediate transferring belt 70 is driven in such a manner that a driving force from a belt driving unit such as a motor is delivered through the driving roller 71*a*.

The full-color toner image formed on the intermediate transferring belt 70 is transferred onto the transfer medium such as a paper sheet by the secondary transferring unit 80.

The transfer medium is transported from a feeding tray to the secondary transferring unit 80 through a feeding roller 94*a* and a resist roller 94*b*.

A full-color liquid developer image transferred onto the transfer medium is heated and pressurized by the fixing unit 90 to be melted and fixed on the transfer medium. The transfer medium passes through the fixing unit 90 and then is discharged by a discharging roller 94*c*.

On the other hand, the photosensitive members 20 (Y, M, C, and K) pass through the primary transferring sections B1, B2, B3, and B4, and then the electric charge is charge-removed by an electric charge removing unit (not shown). Thereafter, the toner attached on the surface are scraped and removed by the photosensitive member cleaning blades 76 (Y, M, C, and K) supported in the photosensitive member cleaning units 75 (Y, M, C, and K). Then, the photosensitive members 20 (Y, M, C, and K) are ready to form a subsequent latent image. The scraped and removed toner is collected by a remaining toner collecting member included in the photosensitive member cleaning units 75 (Y, M, C, and K).

An intermediate transferring belt cleaning unit (not shown) is disposed on a side of the driven roller 71*b* of the intermediate transferring belt 70 subjected to secondary transfer to clean the intermediate transferring belt 70 subjected to secondary transfer. An intermediate transfer method using the intermediate transferring belt has been described according to the embodiment, but a direct transfer type image forming apparatus may be used.

Next, the developing cartridge 50Y will be described.

In the developing cartridge 50Y, toner in different deterioration states (a charging property and the like) coexists in the developing chamber 51Y, when development drive is performed for a long time.

Examples of toner deterioration include deterioration in toner fluidity caused when an external additive agent such as hydrophobic silica added to toner is buried or isolated due to mechanical stress applied to toner, increase in small-diameter toner caused due to toner crush, accumulation of small-diameter toner in a developing device when development is performed selectively depending on the particle diameter of toner due to a proportion of a charging amount of toner at the time of development with respect to the particle diameter of toner, deterioration in fluidity caused due to the small-diameter toner, and occurrence of condensed clump due to deterioration in the fluidity. These examples of the toner deterioration result in image deterioration.

Since the charging amount of the small-diameter toner is excessively increased with ease and an image force is strongly applied to a latent image carrier, attachment (so-called image blushing) of toner to a non-image portion is observed in an image. In addition, since the small-diameter toner easily flies, the small-diameter toner flies from an opening of the developing device, thereby contaminating the inside of an image forming apparatus.

When toner fluidity deteriorates, frictional charge of toner in the developing device becomes insufficient. Therefore, toner having a polarity opposite to a desired charge polarity occurs. The toner having the opposite polarity is observed as the image blushing.

Since the toner deteriorating in the fluidity or the condensed clump of the toner cannot smoothly pass through a contact portion between the developing roller 52Y and the regulation blade 54Y and the charge is not sufficient, the image blushing may occur. Moreover, the condensed clump of the toner is melted and fixed (so-called filming) on the surface of the developing roller 52Y or the regulation blade 54Y due to a mechanical force or frictional heat in the contact portion between the developing roller 52Y and the regulation blade 54Y. When the condensed clump is excessively large, the condensed clump is clogged in the contact portion. Since a toner layer is not formed on the developing roller 52Y in the contact portion in which the filming or the like occurs, an image corresponding to the position is observed as a white line (image blank).

Figure 3:
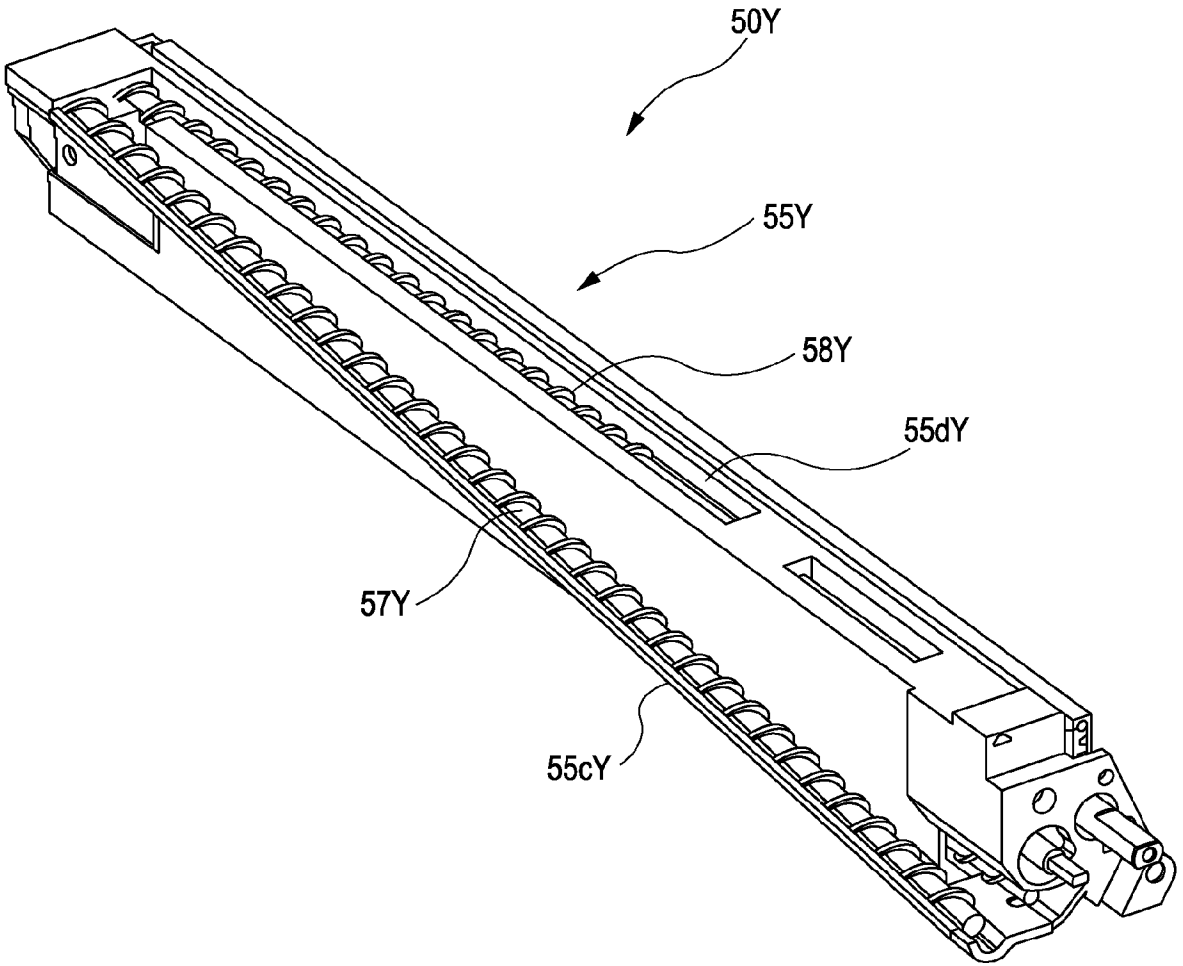
FIG. 3 is a perspective view illustrating the developing cartridge according to a first embodiment of the invention.
Figure 4:
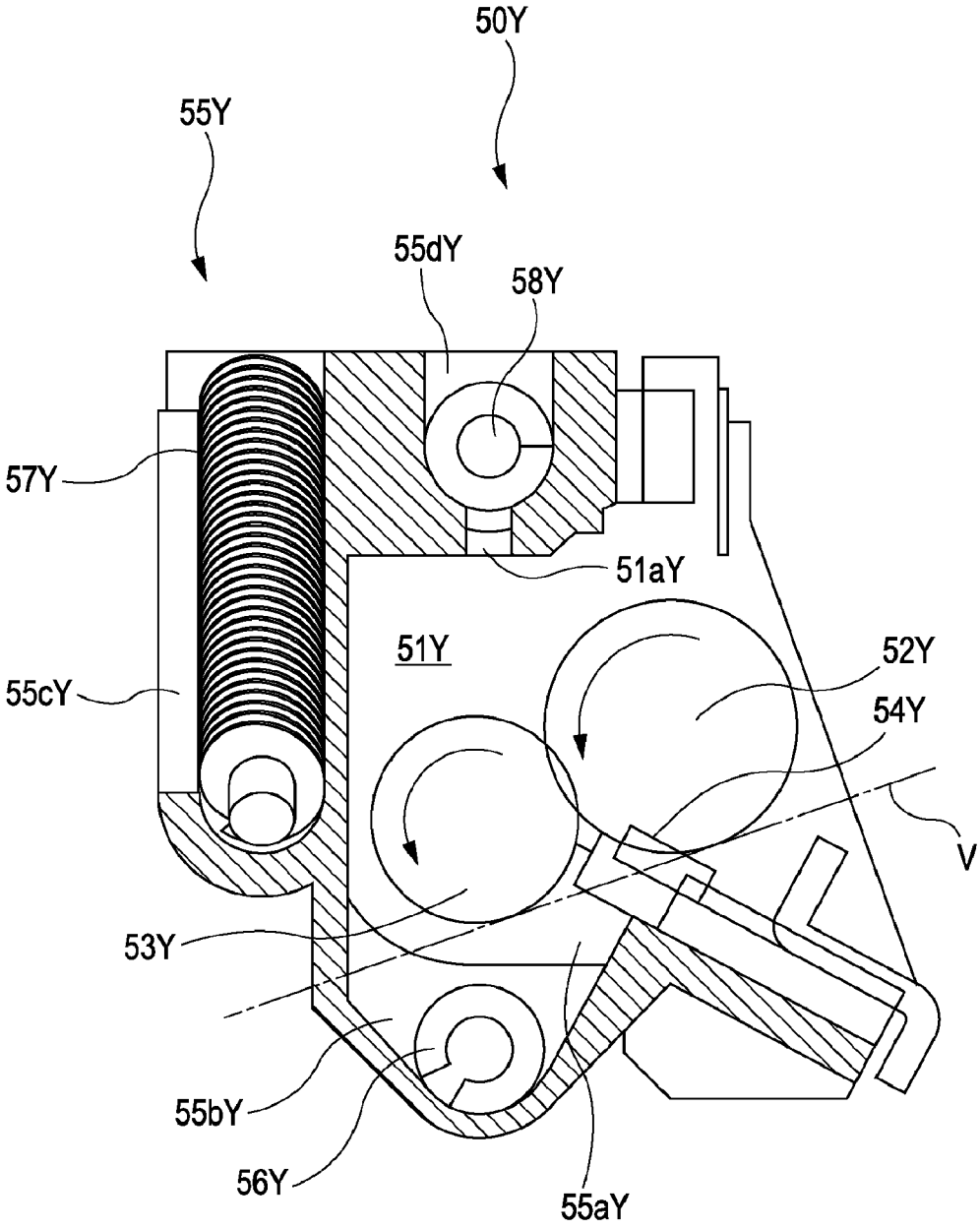
FIG. 4 is a sectional view illustrating the developing cartridge of FIG. 3 viewed in a direction perpendicular to an axial direction.

FIG. 3 is a perspective view illustrating the developing cartridge 50Y according to a first embodiment of the invention. FIG. 4 is sectional view illustrating the developing cartridge 50Y of FIG. 3 viewed in a direction perpendicular to an axial direction.

As shown in FIGS. 3 and 4, the developing cartridge 50Y according to the first embodiment includes the developing chamber 51Y and the transport section 55Y. The developing chamber 51Y and the transport section 55Y are divided by a lower tangent line between the developing roller 52Y and the toner supply roller 53Y, which is referred to as a boundary line V. A space formed from a developing chamber entrance 51*a*Y to the boundary line V is the developing chamber 51Y. In addition, a space 55*a*Y formed below the boundary line V, a lower transport passage 55*b*Y, an upward transport passage 55*c*Y, and an upper transport passage 55*d*Y are included in the transport section 55Y.

The developing chamber 51Y includes the developing roller 52Y and the toner supply roller 53Y. The toner supply roller 53Y supplies toner to the developing roller 52Y and can be rotated in any direction. The developing roller 52Y is rotated counterclockwise. The toner is supplied from the toner supply roller 53Y to the developing roller 52Y.

The transport section 55Y includes the space 55*a*Y formed below the boundary line V, the lower transport passage 55*b*Y, the upward transport passage 55*c*Y, and the upper transport passage 55*d*Y. The lower transport passage 55*b*Y, the upward transport passage 55*c*Y, and the upper transport passage 55*d*Y includes a lower transport member 56Y as a lower transport unit, an upward transport member 57Y as an upward transport unit, and an upper transport member 58Y as an upper transport unit, respectively. In FIG. 3, parts of the respective transport members are exposed for description.

The space 55*a*Y formed below the boundary line V is a space where the toner mainly passing through the nip portion of the developing roller 52Y and the toner supply roller 53Y drops to the lower transport passage 55*b*Y.

The lower transport member 56Y disposed below the developing cartridge 50Y, particularly, below the toner supply roller 53Y collects the toner dropping from the space 55*a*Y formed below the boundary line V and transports the toner in a first direction as an axial direction while agitating the toner. The lower transport member 56Y includes a screw conveyor.

The upward transport member 57Y transports the toner transported by the lower transport member 56Y in an upward direction of the developing cartridge 50Y and a direction reverse to the first direction in the outside of the developing chamber 51Y, while agitating the toner. The upward transport member 57Y includes a screw conveyor.

The upper transport member 58Y transports the toner transported to the upper portion by the upward transport member 57Y to the developing chamber entrance 51*a*Y of a substantial center portion in the axial direction. The upper transport member 58Y transports the toner in the first direction as the axial direction while agitating the toner, and includes a screw conveyor.

The transport members 56Y, 57Y, and 58Y are driven by a driving unit (not shown). One driving unit may drive the transport members 56Y, 57Y, and 58Y. Alternatively, a plurality of driving units provided in correspondence with the transport members 56Y, 57Y, and 58Y may drive the transport members 56Y, 57Y, and 58Y, respectively.

The regulation blade 54Y disposed above or below the developing roller 52Y regulates an amount of toner to be carried on the developing roller 52Y. When the regulation blade 54Y is provided below the developing roller 52Y so as to come in contact with the developing roller 52Y in a counter direction with respect to a rotation direction of the developing roller 52Y, it is easier for the toner passing through the nip portion of the developing roller 52Y and the toner supply roller 53Y to drop to the lower transport passage 55*b*Y.

In this embodiment, in the developing cartridge 50Y including the developing chamber 51Y and the transport section 55Y, a capacity of the transport section 55Y is configured to be larger than a capacity of the developing chamber 51Y. That is, a relation of the capacity of the toner transport section>the capacity of the developing chamber is satisfied.

By allowing the capacity of the transport section 55Y to be larger than the capacity of the developing chamber 51Y, it is possible to increase a toner transport ability and also increase an agitating ability in the power transport member 56Y, the upward transport member 57Y, and the upper transport member 58Y of the transport section 55Y.

Figure 5A:
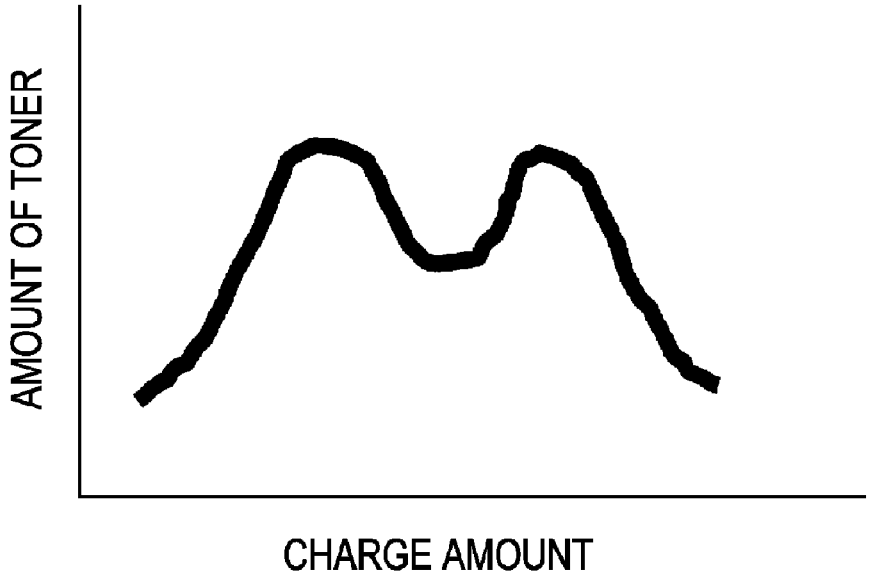
FIG. 5A is a graph illustrating an amount of toner with respect to a charge amount of toner in a space below a boundary line.
Figure 5B:
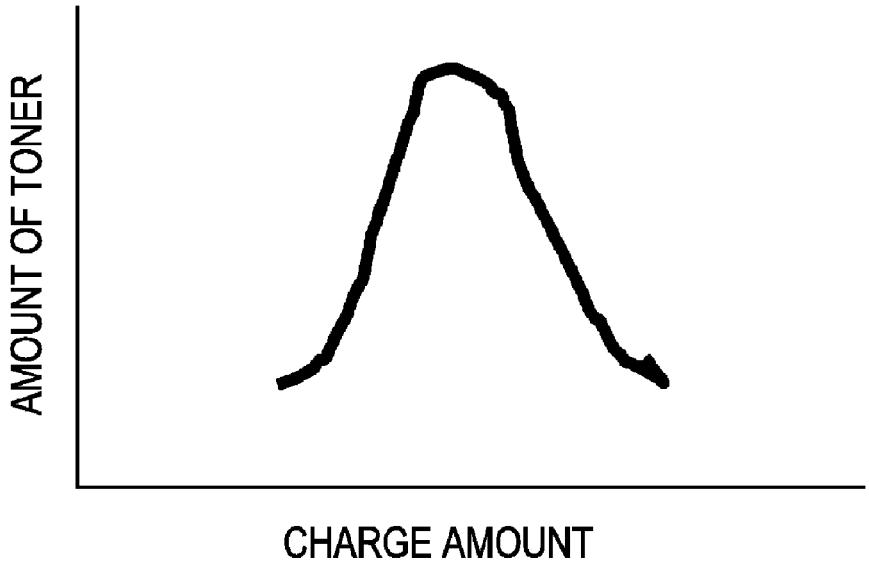
FIG. 5B is a graph illustrating an amount of toner with respect to a charge amount of toner in the vicinity of a developing chamber entrance.

FIGS. 5A and 5B are graphs illustrating a charge amount of toner and an amount of toner in the space 55*a*Y formed below the boundary line V and a charge amount of toner in the vicinity of the developing chamber entrance 51*a*Y, respectively.

FIG. 5A shows the amount of toner with respect to the charge amount of toner in the space 55*a*Y formed below the boundary line V. As apparent from FIG. 5A, the toner in the space 55*a*Y formed below the boundary line V has two peaks in the charge amount of toner. Therefore, the charge amount of toner is not uniform.

FIG. 5B shows the amount of toner with respect to the charge amount of toner in the vicinity of the developing chamber entrance 51*a*Y. By allowing the capacity of the transport section 55Y to be larger than the capacity of the developing chamber 51Y and sufficiently agitating the toner, the toner in the vicinity of the developing chamber entrance 51*a*Y has one peak in the charge amount of toner, as shown in FIG. 5B. Therefore, the charge amount of toner becomes uniform.

Figure 6:
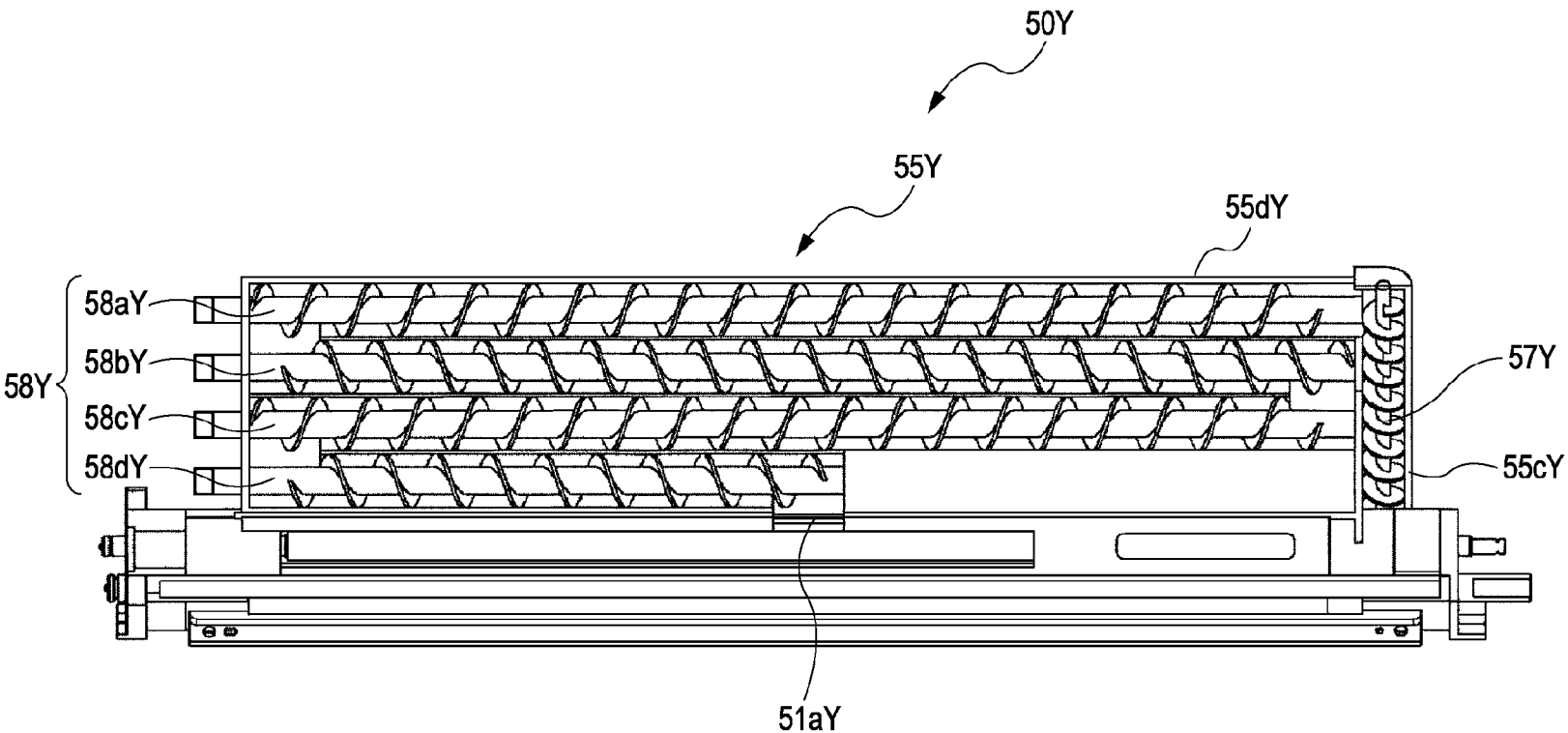
FIG. 6 is a top view illustrating a developing cartridge according to a second embodiment of the invention.
Figure 7:
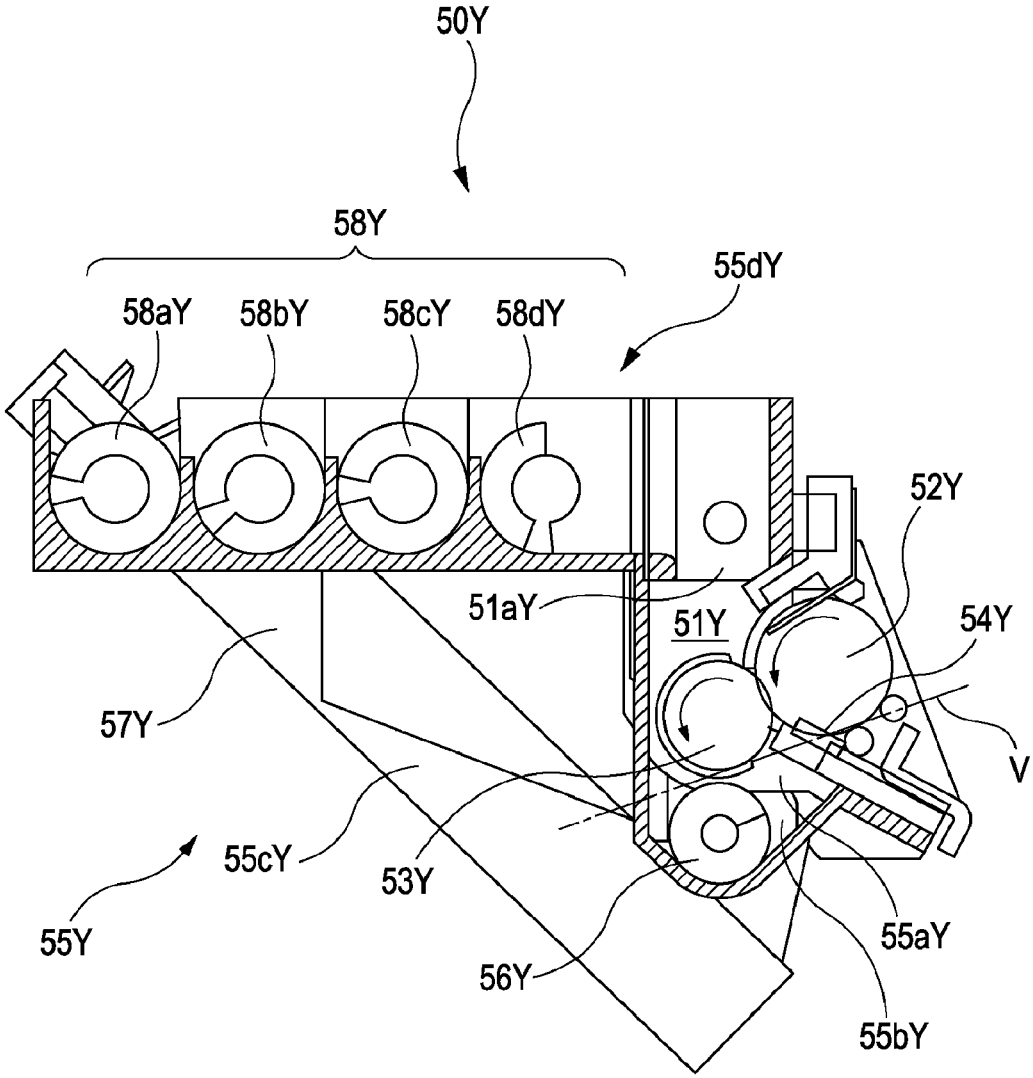
FIG. 7 is a sectional view illustrating the developing cartridge of FIG. 6 viewed in a direction perpendicular to an axial direction.

FIG. 6 is a top view illustrating the developing cartridge 50Y according to a second embodiment of the invention. FIG. 7 is a sectional view illustrating the developing cartridge 50Y of FIG. 6 viewed in a direction perpendicular to the axial direction.

Like the first embodiment, as shown in FIGS. 6 and 7, the developing cartridge 50Y according to the second embodiment includes the developing chamber 51Y and the transport section 55Y. The developing chamber 51Y and the transport section 55Y are divided by a lower tangent line between the developing roller 52Y and the toner supply roller 53Y, which is referred to as a boundary line V. A space formed from a developing chamber entrance 51*a*Y to the boundary line V is the developing chamber 51Y. In addition, a space 55*a*Y formed below the boundary line V, a lower transport passage 55*b*Y, an upward transport passage 55*c*Y, and an upper transport passage 55*d*Y are included in the transport section 55Y.

The developing chamber 51Y includes the developing roller 52Y and the toner supply roller 53Y. The toner supply roller 53Y supplies toner to the developing roller 52Y and can be rotated in any direction. The developing roller 52Y is rotated counterclockwise. The toner is supplied from the toner supply roller 53Y to the developing roller 52Y.

The transport section 55Y includes the space 55*a*Y formed below the boundary line V, the lower transport passage 55*b*Y, the upward transport passage 55*c*Y, and the upper transport passage 55*d*Y. The lower transport passage 55*b*Y, the upward transport passage 55*c*Y, and the upper transport passage 55*d*Y include a lower transport member 56Y as a lower transport unit, an upward transport member 57Y as an upward transport unit, and an upper transport member 58Y as an upper transport unit, respectively. In FIG. 6, parts of the respective transport members are exposed for description.

The space 55*a*Y formed below the boundary line V is a space where the toner mainly passing through the nip portion of the developing roller 52Y and the toner supply roller 53Y drops to the lower transport passage 55*b*Y.

The lower transport member 56Y disposed below the developing cartridge 50Y, particularly, below the toner supply roller 53Y collects the toner dropping from the developing chamber 51Y and transports the toner in the first direction as the axial direction while agitating the toner. The lower transport member 56Y includes a screw conveyor.

The upward transport member 57Y transports the toner transported by the lower transport member 56Y in an upward direction of the developing cartridge 50Y and a direction perpendicular to the first direction in the outside of the developing chamber 51Y, while agitating the toner. The upward transport member 57Y includes a screw conveyor.

The upper transport member 58Y is formed such that a plurality of members are arranged in parallel in a direction perpendicular to the first direction in the upper portion of the developing cartridge 50Y. The upper transport member 58Y includes a first upper transport member 58*a*Y, a second upper transport member 58*b*Y, a third upper transport member 58*c*Y, and a fourth upper transport member 58*d*Y which alternately transport the toner in the first direction and in a direction reverse to the first direction. The first upper transport member 58*a*Y transports the toner transported to the upper portion by the upward transport member 57Y in the direction reverse to the first direction while agitating the toner, and includes a screw conveyor. The second upper transport member 58*b*Y transports the toner transported by the first upper transport member 58*a*Y in the first direction while agitating the toner, and includes a screw conveyor. The third upper transport member 58*c*Y transports the toner transported by the second upper transport member 58*b*Y in the direction reverse to the first direction while agitating the toner, and includes a screw conveyor. The fourth upper transport member 58*d*Y transports the toner to the developing chamber entrance 51*a*Y of the substantial center portion in the axial direction, and agitates the toner in the first direction as the axial direction while agitating the toner, and includes a screw conveyor.

The transport members 56Y, 57Y, and 58Y are driven by a driving unit (not shown). One driving unit may drive the transport members 56Y, 57Y, and 58Y. Alternatively, a plurality of driving units provided in correspondence with the transport members 56Y, 57Y, and 58Y may drive the transport members 56Y, 57Y, and 58Y, respectively.

The regulation blade 54Y disposed above or below the developing roller 52Y regulates an amount of toner to be carried on the developing roller 52Y. When the regulation blade 54Y is provided below the developing roller 52Y so as to come in contact with the developing roller 52Y in a counter direction with respect to a rotation direction of the developing roller 52Y, it is easier for the toner passing through the nip portion of the developing roller 52Y and the toner supply roller 53Y to drop to the lower transport passage 55*b*Y.

Like the first embodiment, in the second embodiment, in the developing cartridge 50Y including the developing chamber 51Y and the transport section 55Y, a capacity of the transport section 55Y is configured to be larger than a capacity of the developing chamber 51Y. Therefore, it is possible to increase a toner transport ability of the lower transport member 56Y, the upward transport member 57Y, and the upper transport member 58Y of the transport section 55Y. Moreover, it is possible to increase an agitating ability.

The developing cartridge according to the first and second embodiments may be configured as a developing device having configuration in which toner is supplied from a toner cartridge (not shown).

As described above, the developing cartridge 50Y according to this embodiment includes: the developer carrier 52Y carrying the toner; the toner supply member 53Y supplying the toner to the developer carrier 52Y; the regulation member 54Y regulating the amount of toner on the developer carrier 52Y; the developing chamber 51Y including the developer carrier 52Y and the toner supply member 53Y; the transport section 55Y connected to the upper portion and the lower portion of the developing chamber 51Y to transport the toner from the lower portion to the upper portion of the developing chamber 51Y; and the transport members 56Y, 57Y, and 58Y disposed inside the transport section 55Y and transporting the toner while agitating the toner. Since the capacity of the transport section 55Y is larger than the capacity of the developing chamber 51Y, the toner is agitated in the numerous portion of the transport section 55Y. Therefore, it is possible to allow the charge amount of toner in the developing chamber 51Y to be almost uniform.

Moreover, time during which the toner is agitated by the transport members 56Y, 57Y, and 58Y in the transport section 55Y is longer than the time during which the toner passes through the developing chamber 51Y. Accordingly, since the time during which the toner is agitated in the transport section 55Y is longer, it is possible to allow the charge amount of toner in the developing chamber 51Y to be almost uniform.

Since the transport section 55Y includes the portion below the tangent line between the developer carrier 52Y and the toner supply member 53Y and the portion in which the transport members 56Y, 57Y, and 58Y, distinguishment from the developing chamber 51Y is clear. Therefore, measurement of the charge amount of toner becomes easy.

As for the transport members 56Y, 57Y, and 58Y, the lower transport member 56Y is disposed below the developing chamber 51Y and collects the toner, the upward transport member 57Y transports the toner from the lower portion to the upper portion of the developing chamber 51Y, and the upper transport member 58Y is disposed above the developing chamber 51Y and transports the toner to the developing chamber entrance 51*a* of the developing chamber 51Y. Accordingly, since the time during which the toner is agitated in the transport section 55Y is longer, it is possible to allow the charge amount of toner in the developing chamber 51Y to be almost uniform.

The upper transport member 58Y includes the plurality of transport members 55*a*Y to 55*d*Y arranged in parallel and transporting the toner alternately in directions reverse to each other. Accordingly, since the time during which the toner is agitated in the transport section 55Y is longer, it is possible to allow the charge amount of toner in the developing chamber 51Y to be almost uniform.

Since the regulation member 54Y is disposed below the developer carrier 52Y, it is easier for the toner passing through the nip portion of the developing roller 52Y and the toner supply roller 53Y to drop to the lower transport passage 55*b*Y.

The developing device according to the embodiments includes the developing cartridge 50Y and the toner cartridge supplying the toner. Therefore, when new toner is supplied from the toner cartridge, the toner is agitated in the numerous portions in the transport section 55Y. Accordingly, it is possible to allow the charge amount of toner in the developing chamber 51Y to be almost uniform.

The image forming apparatus according to the embodiments at least includes the photosensitive member 20Y on which the electrostatic latent image is formed, the developing device which develops the electrostatic latent image by the developer to form the toner image on the photosensitive member 20Y, the transferring unit 80 which transfers the toner image formed on the photosensitive member 20Y onto the transfer medium, and the fixing unit 90 which fixes the toner image transferred on the transfer medium. Moreover, the developing device described above is mounted on the image forming apparatus. Accordingly, a high quality image can be formed with the almost uniform charge amount of toner.

Figure 8:
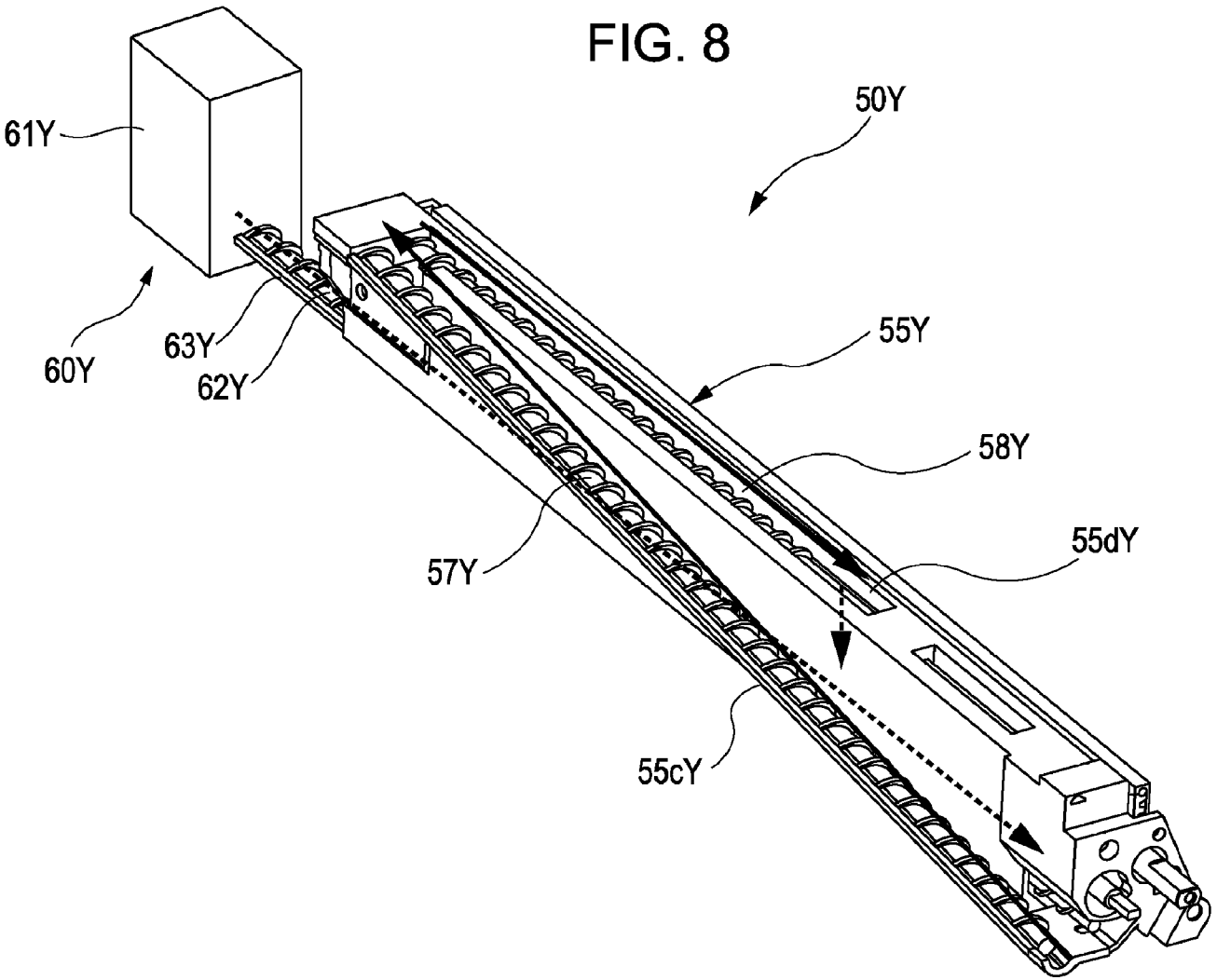
FIG. 8 is a perspective view illustrating the developing cartridge according to a third embodiment of the invention.
Figure 9:
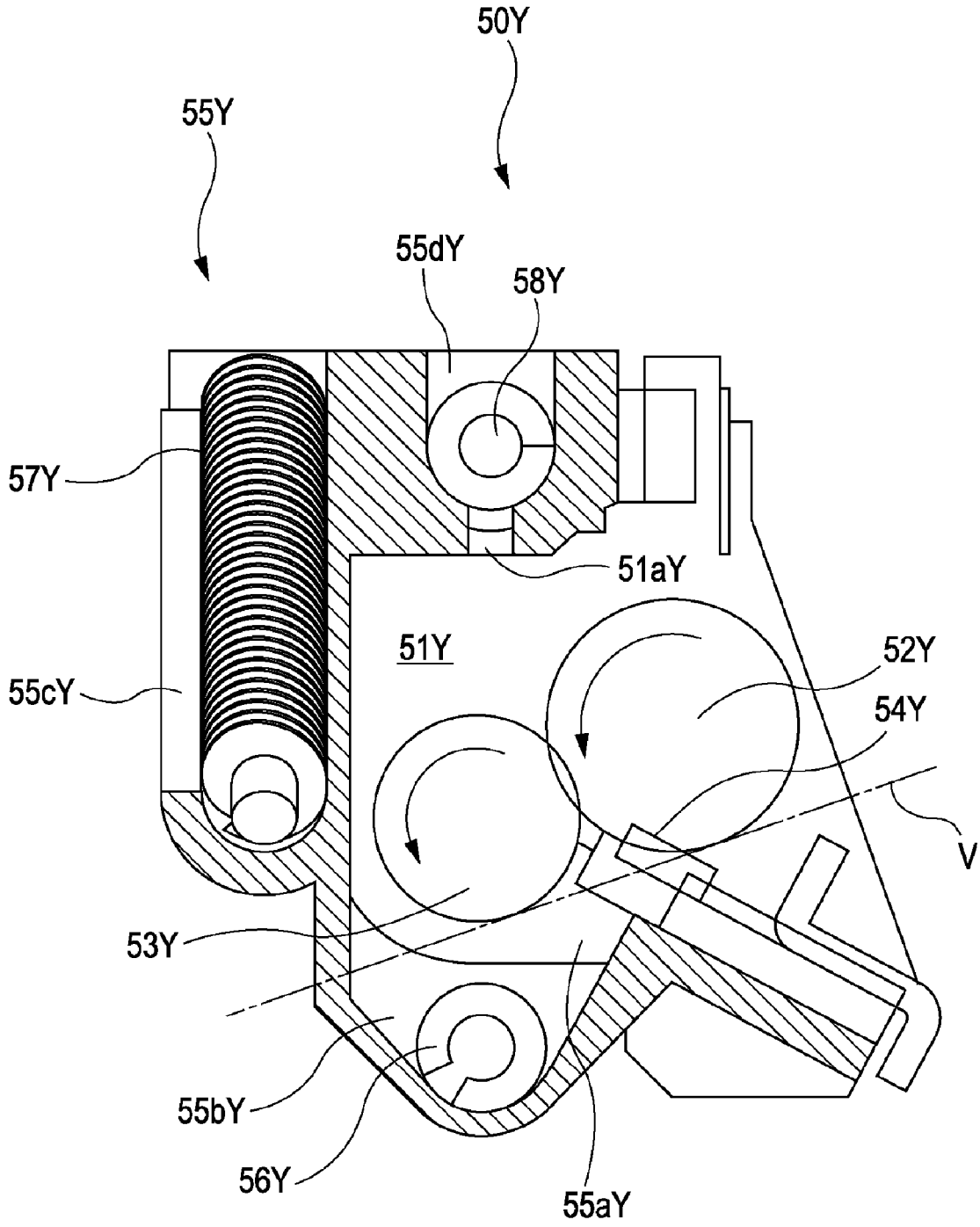
FIG. 9 is a sectional view illustrating the developing cartridge of FIG. 8 viewed in a direction perpendicular to an axial direction.

FIG. 8 is a perspective view illustrating the developing cartridge 50Y according to a third embodiment of the invention. FIG. 9 is sectional view illustrating the developing cartridge 50Y of FIG. 8 viewed in a direction perpendicular to an axial direction.

As shown in FIGS. 8 and 9, the developing cartridge 50Y according to the third embodiment includes the developing chamber 51Y and the transport section 55Y. The developing chamber 51Y and the transport section 55Y are divided by a lower tangent line between the developing roller 52Y and the toner supply roller 53Y, which is referred to as a boundary line V. A space formed from a developing chamber entrance 51*a*Y to the boundary line V is the developing chamber 51Y. In addition, a space 55*a*Y formed below the boundary line V, a lower transport passage 55*b*Y, an upward transport passage 55*c*Y, and an upper transport passage 55*d*Y are included in the transport section 55Y. There is additionally provided a toner giving section 60Y which supplies the new toner to the developing cartridge 50Y.

The developing chamber 51Y includes the developing roller 52Y and the toner supply roller 53Y. The toner supply roller 53Y supplies toner to the developing roller 52Y and can be rotated in any direction. The developing roller 52Y is rotated counterclockwise, so that the toner is supplied from the toner supply roller 53Y to the developing roller 52Y. The regulation blade 54Y is disposed below the developing roller 52Y to regulate the amount of toner on the developing roller 52Y.

The transport section 55Y includes the space 55*a*Y formed below the boundary line V, the lower transport passage 55*b*Y, the upward transport passage 55*c*Y, and the upper transport passage 55*d*Y. The lower transport passage 55*b*Y, the upward transport passage 55*c*Y, and the upper transport passage 55*d*Y includes a lower transport member 56Y as a lower transport unit, an upward transport member 57Y as an upward transport unit, and an upper transport member 58Y as an upper transport unit, respectively. In FIG. 8, parts of the respective transport members are exposed for description.

The space 55*a*Y formed below the boundary line V is a space where the toner mainly passing through the nip portion of the developing roller 52Y and the toner supply roller 53Y drops to the lower transport passage 55*b*Y.

The lower transport member 56Y disposed below the developing cartridge 50Y, particularly, below the toner supply roller 53Y collects the toner dropping from the developing chamber 51Y and transports the toner in the first direction as the axial direction, while agitating the toner. The lower transport member 56Y includes a screw conveyor.

The upward transport member 57Y transports the toner transported by the lower transport member 56Y in an upward direction of the developing cartridge 50Y and a direction perpendicular to the first direction in the outside of the developing chamber 51Y, while agitating the toner. The upward transport member 57Y includes a screw conveyor.

The upper transport member 58Y transports the toner transported to the upper portion by the upward transport member 57Y to the developing chamber entrance 51*a*Y of a substantial center portion in the axial direction. The upper transport member 58Y transports the toner in the first direction as the axial direction, while agitating the toner. In addition, the upper transport member 58Y includes a screw conveyor.

The toner giving section 60Y includes a toner cartridge 61Y, a toner giving member 62Y, and a toner giving passage 63Y. The toner giving section 60Y is connected to the upstream side in the transport direction of the lower transport member 56Y in the lower transport passage 55*b*Y of the transport section 55Y and supplies the toner to the transport section 55Y.

The toner cartridge 61Y is filled with new toner and is configured so as to be detachably mounted on the toner giving member 62Y and the toner giving passage 63Y. The toner giving passage 63Y connects the toner cartridge 61Y to the transport section 55Y of the developing cartridge 50Y and has the toner giving member 62Y therein. The toner giving member 62Y transports the toner in the first direction as the axial direction, while agitating the toner, and includes a screw conveyor. In this embodiment, the toner giving member 62Y and the lower transport member 56Y are the same member.

The transport members 56Y, 57Y, and 58Y are driven by a driving unit (not shown). One driving unit may drive the transport members 56Y, 57Y, and 58Y. Alternatively, a plurality of the driving units may be disposed in correspondence with the transport members 56Y, 57Y, and 58Y.

The regulation blade 54Y disposed above or below the developing roller 52Y regulates an amount of toner to be carried on the developing roller 52Y. When the regulation blade 54Y is provided below the developing roller 52Y so as to come in contact with the developing roller 52Y in a counter direction with respect to a rotation direction of the developing roller 52Y, it is easier for the toner passing through the nip portion of the developing roller 52Y and the toner supply roller 53Y to drop to the lower transport passage 55*b*Y.

Figure 10:
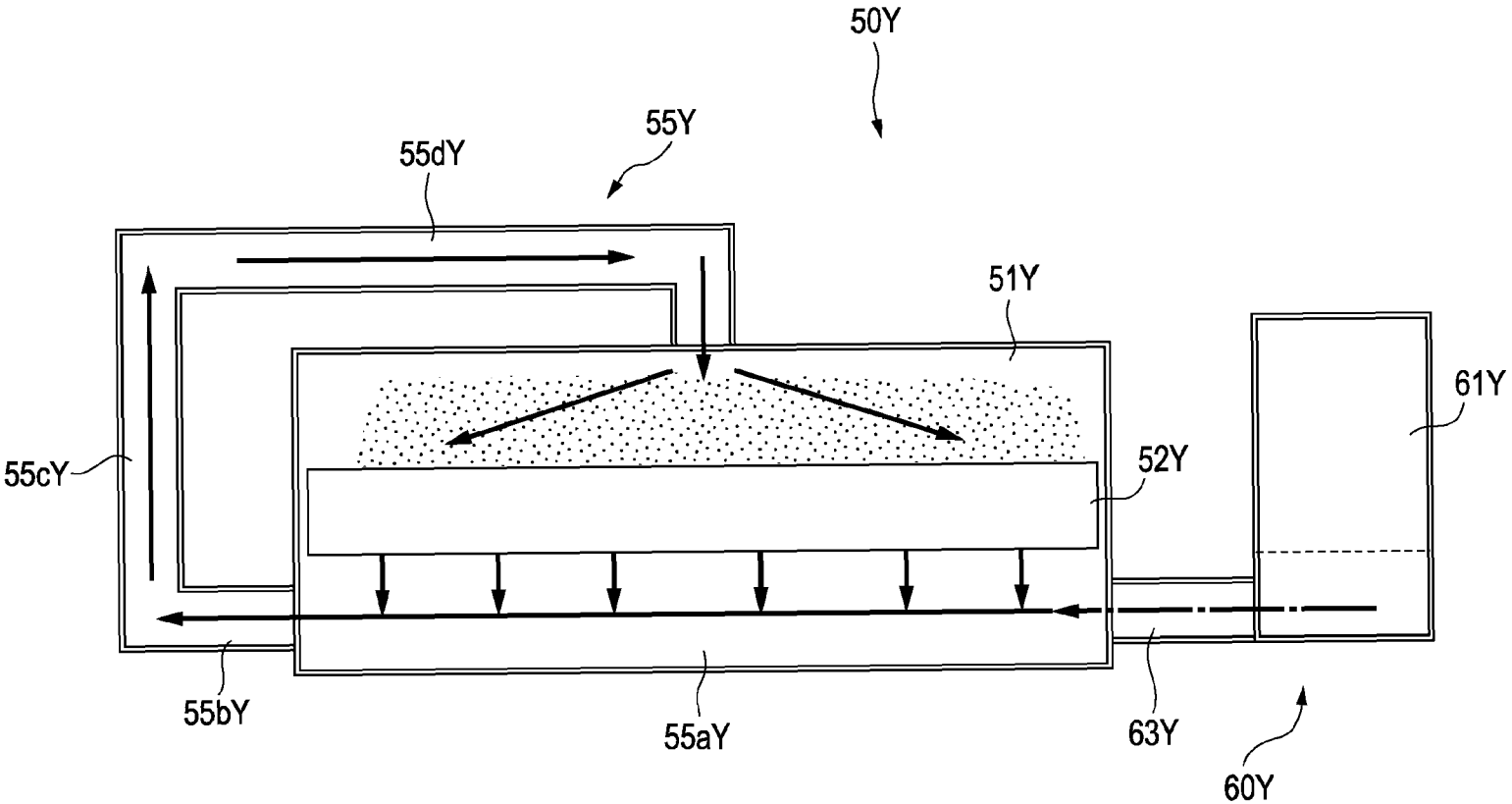
FIG. 10 is a schematic diagram illustrating a flow of toner.

FIG. 10 is a schematic diagram illustrating a flow of toner. The new toner filled in the toner cartridge 61Y is transported in the first direction as the axial direction by the toner giving member 62Y in the toner giving passage 63Y, while being agitated, and then transported to the inside of the transport section 55Y of the developing cartridge 50Y.

Inside the transport section 55Y, the new toner is mixed with the toner passed and collected through the developing roller 52Y, the toner supply roller 53Y, the regulation blade 54Y, and the like, passed through the lower transport member 56Y, the upward transport member 57, the upper transport member 58Y, and again input to the developing chamber 51Y. In this way, since the new toner is mixed and agitated with the collected toner, the charging is uniformly performed. The charging is more uniformly performed thanks to a long distance in which the new toner is mixed and agitated with the collected toner. Therefore, it is preferable that the toner giving passage 63Y is connected to the space 55*a*Y below the boundary line V or the lower transport passage 55*b*Y.

Figure 11:
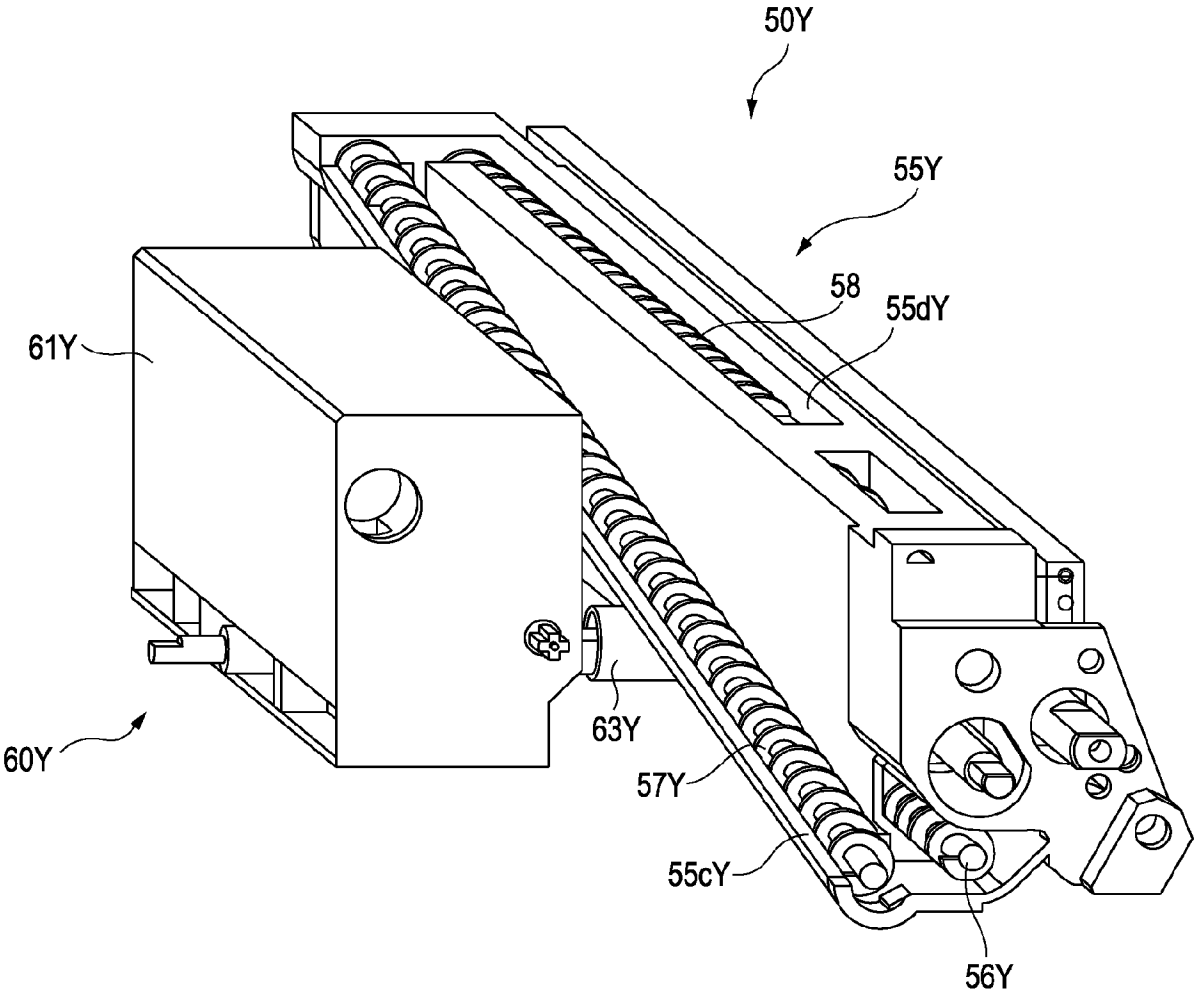
FIG. 11 is a top view illustrating a developing cartridge according to a fourth embodiment of the invention.
Figure 12:
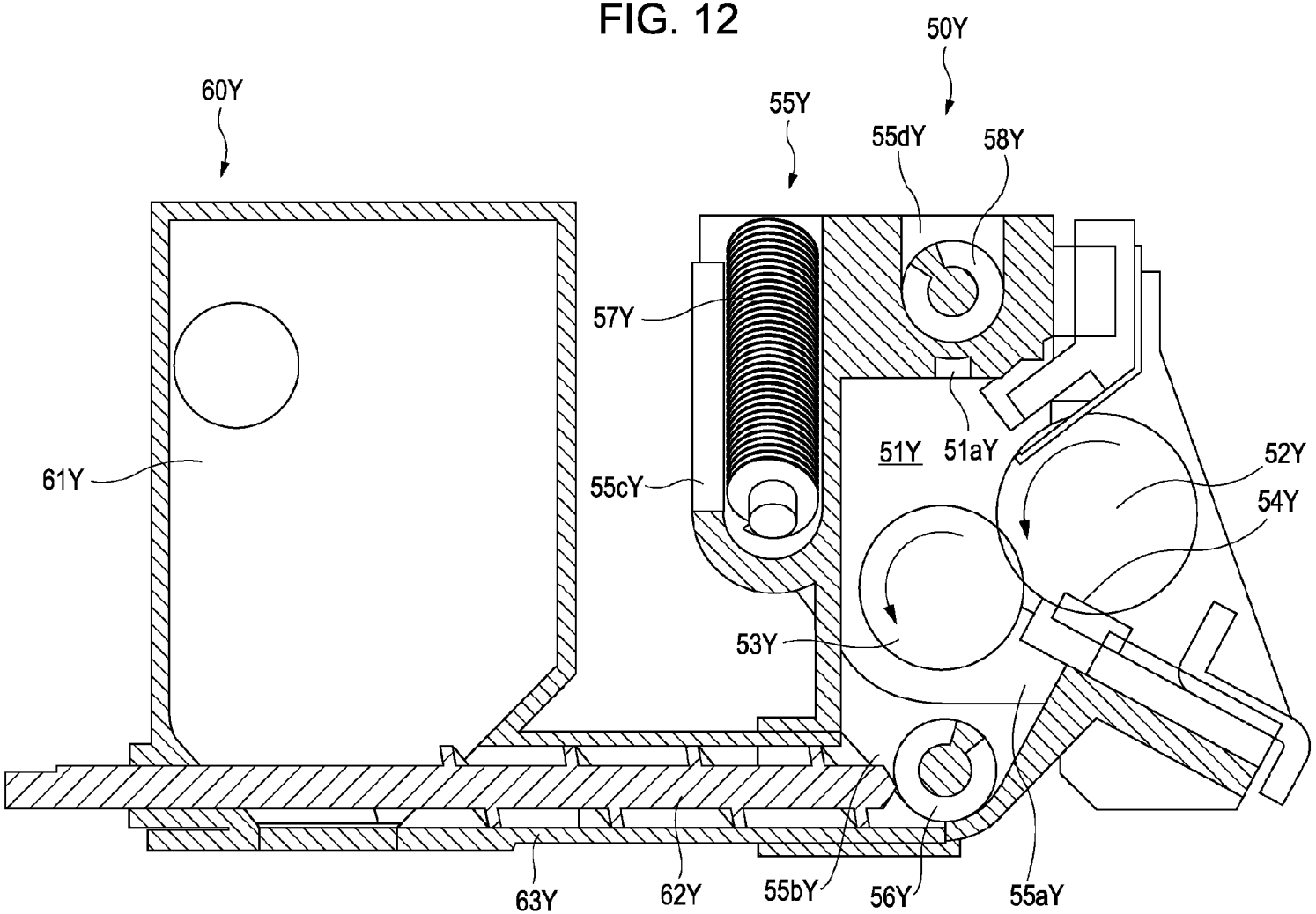
FIG. 12 is a sectional view illustrating the developing cartridge of FIG. 11 viewed in a direction perpendicular to an axial direction.

FIG. 11 is a top view illustrating the developing cartridge 50Y according to a fourth embodiment of the invention. FIG. 12 is a sectional view illustrating the developing cartridge 50Y of FIG. 11 viewed in a direction perpendicular to the axial direction.

As shown in FIGS. 11 and 12, the developing cartridge 50Y according to the fourth embodiment includes the same developing chamber 51Y and the same transport section 55Y as those of the first embodiment. However, a connection location of the toner giving section 60Y is different.

The toner giving section 60Y according to the fourth embodiment includes the toner cartridge 61Y, the toner giving member 62Y, and the toner giving passage 63Y. In addition, the toner giving section 60Y is disposed in a direction intersecting the transport direction at a substantial center of the lower transport member 56Y in the lower transport passage 55*b*Y of the transport section 55Y so as to supply the toner to the transport section 55Y.

The toner cartridge 61Y is filled with new toner and configured so as to be detachably mounted on the toner giving member 62Y and the toner giving passage 63Y. The toner giving passage 63Y is connected to the space 55*a*Y and the lower transport passage 55*by* below the boundary line V between the toner cartridge 61Y and the transport section 55Y of the developing cartridge 50Y. The toner supply passage 63Y includes the toner giving member 62Y therein. The toner giving member 62Y transports the toner in the second direction perpendicular to the axial direction, while agitating the toner. The toner giving member 62Y includes a screw conveyer. In this embodiment, the toner giving member 62Y is a unit different from the lower transport member 56Y.

Since the toner giving member 62Y according to the fourth embodiment is configured to transport the toner in the second direction perpendicular to the axial direction, it is possible to use the toner giving member 62Y, when a space in the axial direction is not sufficient.

As described above, the developing device according to this embodiment includes: the developer carrier 52Y carrying the toner; the toner supply member 53Y supplying the toner to the developer carrier 52Y; the regulation member 54Y regulating the amount of toner on the developer carrier 52Y; the developing chamber 51Y including the developer carrier 52Y and the toner supply member 53Y; the transport section 55Y connected to the upper portion and the lower portion of the developing chamber 51Y to transport the toner from the lower portion to the upper portion of the developing chamber 51Y; the transport members 56Y, 57Y, and 58Y disposed inside the transport section 55Y and transporting the toner while agitating the toner; and the toner giving section 60Y connected to the transport section 55Y to supply the toner to the transport section 55Y. Since the toner having different electric charge can be agitated in the transport section 55Y before supply of the toner to the developing chamber 51Y, it is possible to allow the charge amount of toner in the developing chamber 51Y to be almost uniform.

The transport section 55Y includes the lower transport passage 55*b*Y which is connected to the lower portion of the developing chamber 51Y, the upward transport passage 55*c*Y which is connected to the lower transport passage 55*b*Y and transports the toner from the lower portion to the upper portion in the outside of the developing chamber 51Y, and the upper transport passage 55*d*Y connected to the upward transport passage 55*c*Y and the upper portion of the developing chamber 51Y to transport the toner to the developing chamber 51Y. Moreover, the toner giving section 60Y is connected to the lower transport passage 55*b*Y. With such a configuration, since the toner is agitated in the numerous portions of the transport section 55Y, it is possible to allow the charge amount of toner in the developing chamber 51Y to be further almost uniform.

Since the upper transport passage 55*d*Y is connected to the upper portion of the developing chamber 51Y in the substantial center portion in the axial direction of the developer carrier 52Y, it is possible to supply the toner to the developing chamber 51Y smoothly and uniformly.

The lower transport passage 55*b*Y includes the lower transport member 56Y and the toner giving section 60Y is connected to the upstream side in the transport direction of the lower transport member 56Y in the lower transport passage 55*b*Y. With such a configuration, since the toner is agitated in the numerous portions of the transport section 55Y, it is possible to allow the charge amount of toner in the developing chamber 51Y to be further almost uniform.

The toner giving section 60Y includes the toner cartridge 61Y, the toner giving passage 63Y connecting the toner cartridge 61Y to the transport section 55Y, and the toner giving member 62Y transporting the toner inside the toner giving passage 63Y. Moreover, the toner giving member 62Y and the lower transport member 56Y are the same member. Accordingly, since both the toner giving member 62Y and the lower transport member 56Y can be driven by one driving unit, it is possible to reduce the number of constituent elements or energy.

The toner giving section 60Y includes the toner cartridge 61Y, the toner giving passage 63Y connecting the toner cartridge 61Y to the transport section 55Y, and the toner giving member 62Y transporting the toner inside the toner giving passage 63Y. Moreover, the toner giving member 62Y and the lower transport member 56Y are the different members. Accordingly, a design can be made more freely.

Since the toner giving passage 63Y is disposed in the direction intersecting the transport direction of the lower transport member 56Y, it is possible to make efficient use of the space in the axial direction of the developer carrier 20Y. Accordingly, a design can be made more freely.

The image forming apparatus according to the embodiments at least includes the photosensitive member 20Y on which the electrostatic latent image is formed, the developing device which develops the electrostatic latent image by the developer to form the toner image on the photosensitive member 20Y, the transferring unit 80 which transfers the toner image formed on the photosensitive member 20Y onto the transfer medium, and the fixing unit 90 which fixes the toner image transferred onto the transfer medium. As the developing device, the developing device described above is mounted on the image forming apparatus. Accordingly, a high quality image can be formed with the almost uniform charge amount of toner.

What is claimed is:

1. A developing cartridge comprising:

a developer carrier which carries toner;

a toner supply member which supplies the toner to the developer carrier and which contacts the developer carrier so as to form a nip portion between the developer carrier and the toner supply member;

a regulation member which regulates an amount of toner on the developer carrier;

a developing chamber which has the developer carrier and the toner supply member;

a transport section which is connected to an upper portion and a lower portion of the developing chamber and transports the toner from the lower portion of the developing chamber to the upper portion of the developing chamber, the lower portion of the transport section being formed where the toner passing through the nip portion drops; and a transport member which is disposed inside the transport section and transports the toner while agitating the toner, wherein a capacity of the transport section is larger than a capacity of the developing chamber.

2. The developing cartridge according to claim 1, wherein time during which the transport member agitates the toner in the transport section is longer than time during which the toner passes through the developing chamber.

3. The developing cartridge according to claim 1, wherein the transport section includes a portion below a lower tangent line of the developer carrier and the toner supply member and a portion in which the transport member is disposed.

4. The developing cartridge according to claim 1, wherein the transport member includes:

a lower transport member which is disposed in the lower portion of the developing chamber and collects the toner;

an upward transport member which transports the toner from a lower side of the developing chamber to an upper side of the developing chamber; and an upper transport member which is disposed in the upper portion of the developing chamber and transports the toner to a developing chamber entrance.

5. The developing cartridge according to claim 4, wherein the upper transport member includes a plurality of transport members which are arranged in parallel and transport the toner alternately in directions reverse to each other.

6. The developing cartridge according to claim 1, wherein the regulation member is disposed below the developer carrier.

7. A developing device comprising:

the developing cartridge according to claim 1; and a toner cartridge which supplies toner.

8. An image forming apparatus comprising:

a latent image carrier on which an electrostatic latent image is formed;

a developing device which develops the electrostatic latent image by developer to form a toner image on the latent image carrier;

a transferring unit which transfers the toner image formed on the latent image carrier onto a transfer medium; and a fixing unit which fixes the toner image transferred onto the transfer medium, wherein as the developing device, the developing device according to claim 7 is mounted.

9. A developing device comprising:

a developer carrier which carries toner;

a toner supply member which supplies the toner to the developer carrier and which contacts the developer carrier so as to form a nip portion between the developer carrier and the toner supply member;

a regulation member which regulates an amount of toner on the developer carrier;

a developing chamber which has the developer carrier and the toner supply member;

a transport section which is connected to an upper portion and a lower portion of the developing chamber and transports the toner from the lower portion of the developing chamber to the upper portion of the developing chamber, the lower portion of the transport section being formed where the toner passing through the nip portion drops;

a transport member which is disposed inside the transport section and transports the toner while agitating the toner; and a toner giving section which is connected to the transport section and supplies the toner to the transport section.

10. The developing device according to claim 9, wherein the transport section includes a lower transport passage being connected to a lower portion of the developing chamber and collecting the toner, an upward transport passage being connected to the lower transport passage and transporting the toner from the lower portion to an upper portion of the developing chamber in the outside of the developing chamber, and an upper transport passage connecting the upward transport passage to the upper portion of the developing chamber and transporting the toner to the developing chamber, and wherein the toner giving section is connected to the lower transport passage.

11. The developing device according to claim 10, wherein the upper transport passage is connected to the upper portion of the developing chamber in a center in an axial direction of the developer carrier.

12. The developing device according to claim 10, wherein the lower transport passage includes a lower transport member, and wherein the toner giving section is connected to an upstream side in a transport direction of the lower transport member in the lower transport passage.

13. The developing device according to claim 12, wherein the toner giving section includes:

a toner cartridge;

a toner giving passage which connects the toner cartridge to the transport section; and a toner giving member which transports the toner in the toner giving passage, and wherein the toner giving member and the lower transport member are the same member.

14. The developing device according to claim 12, wherein the toner giving section includes:

a toner cartridge;

a toner giving passage which connects the toner cartridge to the transport section; and a toner giving member which transports the toner in the toner giving passage, and wherein the toner giving member and the lower transport member are different from each other.

15. The developing device according to claim 14, wherein the toner giving passage is disposed in a direction intersecting the transport direction of the lower transport member.

16. An image forming apparatus comprising:

a latent image carrier on which an electrostatic latent image is formed;

a developing device which develops the electrostatic latent image by developer to form a toner image on the latent image carrier;

a transferring unit which transfers the toner image formed on the latent image carrier onto a transfer medium; and a fixing unit which fixes the toner image transferred onto the transfer medium, wherein as the developing device, the developing device according to claim 9 is mounted.

* * * * *